US008551588B2

(12) United States Patent
Daffner et al.

(10) Patent No.: US 8,551,588 B2
(45) Date of Patent: Oct. 8, 2013

(54) RESEALABLE LAMINATE FOR HEAT SEALED PACKAGING

(75) Inventors: Martin Daffner, Long Beach, CA (US); Bassam Hallak, Newport (AU)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 13/262,521

(22) PCT Filed: Mar. 31, 2010

(86) PCT No.: PCT/US2010/029352

§ 371 (c)(1), (2), (4) Date: Nov. 29, 2011

(87) PCT Pub. No.: WO2010/114879

PCT Pub. Date: Oct. 7, 2010

(65) Prior Publication Data

US 2012/0067896 A1 Mar. 22, 2012

Related U.S. Application Data

(60) Provisional application No. 61/165,008, filed on Mar. 31, 2009.

(51) Int. Cl.
*B29D 22/00* (2006.01)

(52) U.S. Cl.
USPC ..... 428/35.2; 428/35.9

(58) Field of Classification Search
USPC ..... 428/35.2, 35.9; 220/359.3, 359.4; 156/289
See application file for complete search history.

(56) References Cited

U.S. PATENT DOCUMENTS

| | | | |
|---|---|---|---|
| 3,329,331 | A | 7/1967 | Morgan |
| 3,454,210 | A | 7/1969 | Spiegel et al. |
| 4,260,061 | A | 4/1981 | Jacobs |
| 4,810,541 | A | 3/1989 | Newman et al. |
| 5,089,320 | A | 2/1992 | Straus et al. |
| 5,382,472 | A | 1/1995 | Yanidis et al. |
| 5,623,011 | A | 4/1997 | Bernard |
| 5,728,469 | A | 3/1998 | Mann et al. |
| 5,830,571 | A | 11/1998 | Mann et al. |
| 5,882,749 | A | 3/1999 | Jones et al. |

(Continued)

FOREIGN PATENT DOCUMENTS

| | | |
|---|---|---|
| DE | 102006002965 | 8/2007 |
| EP | 0447636 | 9/1991 |

(Continued)

OTHER PUBLICATIONS

International Search Report dated Oct. 7, 2010 for International Patent Application Serial No. PCT/US2010/029352 filed Sep. 30, 2010.

(Continued)

*Primary Examiner* — N. Edwards
(74) *Attorney, Agent, or Firm* — Avery Dennison Corporation

(57) ABSTRACT

A resealable and disposable package assembly is described. The assembly includes a container and a multilayer cover laminate that are bonded to one another to initially seal the contents of the package. The package can then be easily opened by at least partially separating the cover laminate along a predesignated interface. The package can be reliably and effectively sealed by recontacting the previously separated cover portions to one another.

20 Claims, 7 Drawing Sheets

(56) References Cited

U.S. PATENT DOCUMENTS

| | | | | |
|---|---|---|---|---|
| 5,882,789 | A | 3/1999 | Jones et al. | |
| 5,919,547 | A | 7/1999 | Kocher et al. | |
| 6,056,141 | A | 5/2000 | Navarini et al. | |
| 6,147,165 | A | 11/2000 | Lee et al. | |
| 6,302,290 | B1 | 10/2001 | Engelaere | |
| 6,486,267 | B1 | 11/2002 | Bilodeau | |
| 6,630,237 | B2 | 10/2003 | Rivett et al. | |
| 6,737,130 | B2 | 5/2004 | Ferri | |
| 6,752,431 | B1 | 6/2004 | Matthews et al. | |
| 6,777,050 | B1 | 8/2004 | Engelaere | |
| 6,893,672 | B2 | 5/2005 | Ingraham | |
| 6,902,817 | B2 | 6/2005 | Bowen et al. | |
| 7,165,888 | B2 | 1/2007 | Rodick | |
| 7,322,473 | B2 | 1/2008 | Fux | |
| 7,371,008 | B2 | 5/2008 | Bonenfant | |
| 7,422,782 | B2 | 9/2008 | Haedt et al. | |
| 2004/0013827 | A1 | 1/2004 | Zuser et al. | |
| 2004/0033379 | A1 | 2/2004 | Grunlan et al. | |
| 2004/0180118 | A1 | 9/2004 | Renger et al. | |
| 2004/0191459 | A1 | 9/2004 | Driesten | |
| 2005/0031233 | A1 | 2/2005 | Varanese et al. | |
| 2005/0074549 | A1 | 4/2005 | Su et al. | |
| 2005/0276525 | A1 | 12/2005 | Hebert et al. | |
| 2006/0172131 | A1 | 8/2006 | Haedt et al. | |
| 2007/0082161 | A1 | 4/2007 | Cruz et al. | |
| 2007/0116910 | A1 | 5/2007 | Polykarpov et al. | |
| 2007/0134459 | A1 | 6/2007 | Hubert et al. | |
| 2007/0275133 | A1 | 11/2007 | Sierra-Gomez et al. | |
| 2008/0118688 | A1 | 5/2008 | Kinigakis et al. | |
| 2008/0156861 | A1 | 7/2008 | Sierra-Gomez et al. | |
| 2012/0067896 | A1* | 3/2012 | Daffner et al. | 220/359.3 |
| 2012/0177307 | A1* | 7/2012 | Duan et al. | 383/211 |
| 2013/0020328 | A1 | 1/2013 | Duan et al. | |
| 2013/0056470 | A1 | 3/2013 | Hallak | |

FOREIGN PATENT DOCUMENTS

| | | |
|---|---|---|
| EP | 0608801 | 8/1994 |
| EP | 1016598 | 7/2000 |
| EP | 1193294 | 4/2002 |
| EP | 1449789 | 8/2004 |
| EP | 1582341 | 10/2005 |
| EP | 1685954 | 8/2006 |
| EP | 1775122 | 4/2007 |
| GB | 2319746 | 6/1998 |
| WO | WO94/29104 | 12/1994 |
| WO | WO96/03329 | 2/1996 |
| WO | WO02/066341 | 8/2002 |
| WO | WO2004/074130 | 9/2004 |
| WO | 2005014406 | 2/2005 |
| WO | WO2005/123535 | 12/2005 |
| WO | WO2008/086388 | 7/2008 |
| WO | WO2008/115693 | 9/2008 |
| WO | WO2009/089009 | 7/2009 |

OTHER PUBLICATIONS

Written Opinion dated Sep. 30, 2011 for International Patent Application Serial No. PCT/US2010/029352 filed Sep. 30, 2010.

European Patent Office Communication Pursuant to Article 94(3) EPC issued in corresponding EP Application No. 10 712 843.1 dated Oct. 29, 2012.

Response to European Patent Office Communication Pursuant to Rules 161(1) and 162 EPC dated Nov. 8, 2011, as well as to the Written Opinion of the ISA dated Oct. 4, 2011 as filed in corresponding EP Application No. 10 712 843.1 dated May 11, 2012.

Response to European Patent Office Communication Pursuant to Rules 161(1) and 162 EPC dated Apr. 26, 2012 in corresponding EP Application No. 10 759 767.6 dated Nov. 7, 2012.

International Search Report and Written Opinion issued in corresponding IA No. PCT/US2010/048558 dated Nov. 16, 2010.

International Preliminary Report on Patentability issued in corresponding IA No. PCT/US2010/029352 dated Oct. 13, 2011.

International Search Report and Written Opinion issued in corresponding IA No. PCT/US2011/037637 dated Sep. 21, 2011.

International Preliminary Report on Patentability issued in corresponding IA No. PCT/US2011/030255 dated Oct. 11, 2012.

International Search Report and Written Opinion issued in corresponding IA No. PCT/US2011/030255 dated Jun. 30, 2011.

International Search Report and Written Opinion issued in corresponding IA No. PCT/US2011/030246 dated Aug. 11, 2011.

* cited by examiner

RESEALABLE LAMINATE FOR HEAT SEALED PACKAGING

CROSS-REFERENCE TO RELATED APPLICATION

The present application is a 371 of International Application No. PCT/US2010/029352, which published in English on Oct. 7, 2010, and claims priority to U.S. Provisional Patent Application No. 61/165,008 filed Mar. 31, 2009, both of which are incorporated herein by reference in their entireties.

FIELD OF THE INVENTION

The present invention relates to heat sealable packages that are also resealable.

BACKGROUND OF THE INVENTION

A wide array of resealable containers are known. Typically, a container such as in the form of a flexible bag or rigid walled housing, is provided with an opening that serves to provide access to the interior of the container. A lid or cover is positioned over the opening and bonded to the container, typically by heat sealing, to enclose and seal the container interior and its contents from the external environment. For bag type containers, a portion of the flexible wall of the bag may serve as the cover and be folded or otherwise positioned over an opening in the bag. A reseal feature enables the lid or cover, or a portion thereof, to be removed or otherwise repositioned so as to allow access to the interior of the container. After accessing the interior of the container, the lid or cover can be appropriately positioned over the opening and engaged with the container to thereby reseal the container.

Numerous strategies have been devised for the lid or cover to overlay a container opening and engage the container to thereby seal the interior of the container from the outside environment. An example of a sealing strategy is the provision of corresponding, e.g. male and female, engagement structures on the respective contacting surfaces of the container and lid. Another example is the use of a layer of a pressure sensitive adhesive on the contacting surfaces of the lid or cover, and/or the corresponding region of the container extending about the periphery of the opening. This latter strategy is widely used, particularly for disposable packaging as used for storing and preserving perishable items such as food in which it is desirable to minimize exposure to air. For example, U.S. Pat. No. 3,329,331 describes a box having a top or wall section resealable by use of a layer of pressure sensitive adhesive.

As packaging technology developed, polymeric materials have been increasingly used in various multi-layer laminates for both containers and covers. It is well known to utilize certain polymeric materials in a laminate container and cover assembly, and to thermally bond such materials together in order to initially seal the resulting package. An example of this approach is described in U.S. Pat. No. 5,062,569 for a heat sealable container and lid assembly.

If however, a resealable function is desired, it is generally not possible to effectively and reliably perform the resealing using the same polymeric materials as used for the initial thermal sealing of the container. As a result, artisans devised multi-layer laminate assemblies containing both heat sealing materials and pressure sensitive adhesives. An example of such an assembly is described in U.S. Pat. No. 3,454,210. In that patent, multilayer laminates are used in both a cover and a base assembly. A heat sealable layer between the cover and base thermally bonds the components together in an initial sealing operation. Upon removal of the cover, a layer of the cover then ruptures, thereby exposing the pressure sensitive adhesive. The lid can be resealed to the container by contacting the pressure sensitive adhesive to a corresponding face on the container. A similar strategy is also described in U.S. Pat. No. 7,422,782.

Although satisfactory in many respects, package assemblies such as that disclosed in the '210 patent have several limitations. One such limitation stems from the provision of the heat sealing material and the pressure sensitive adhesive being positioned generally within the same layer or stratum of the cover laminate. This requires careful application of heat to only those regions at which the heat sealing material exists, use of heat-resistant pressure sensitive adhesives, and careful manufacturing of the lid laminate, for example. All of these concerns increase manufacturing and sealing complexity and costs. Furthermore, potential exposure to the pressure sensitive adhesive by the contents of the container, would likely be undesirable for food packaging applications.

As a result of these and other practices in the industry, resealable lid or cover laminates utilizing an underside with a heat sealing layer, and a pressure sensitive adhesive layer disposed at a different position in the laminate have been devised. Examples of these types of resealable packaging assemblies are disclosed in U.S. Pat. No. 6,302,290; US Publication 2004/0180118; and GB 2,319,746. The '290 patent and the '118 publication are directed to resealable container assemblies with multilayer covering sheets or films that are initially heat sealed to a container, and then upon opening of the container by removal of a portion of the sheet, a bead remains thermally bonded to an upwardly facing surface of the container. The bead assists in subsequent sealing by contacting an exposed region of a pressure sensitive adhesive carried by the sheet. The bead and/or its formation is achieved by use of a shifted strata arrangement of layers in the multilayer sheet. Although satisfactory in numerous regards, these container assemblies would likely not be suitable for sensitive and perishable food items that are frequently initially vacuum sealed and/or which must exhibit low oxygen permeability properties.

As far as is known, the previously noted GB '746 patent is the earliest disclosure of a resealable lid and container assembly in which the lid and container utilize opposing heat sealing layers for initial thermal sealing of the container, the lid utilizes a multi-layer assembly with an adhesive layer that is ruptured upon opening of the sealed container, and which lid also includes a barrier layer such as formed from polyvinylidene chloride (PVDC), thereby rendering the container potentially eligible for packaging perishable and/or sensitive food items.

However, it is believed that a variety of additional limitations are associated with each of the container systems described in the previously noted '290 patent, '118 publication, and the GB '746 patent. For example, the shifted strata arrangement of layers in the covering sheets and films described in the '290 patent and the '118 publication would be tedious and costly to produce, particularly in a high volume manufacturing context. The GB '746 patent fails to disclose a practical embodiment beyond its conceptual disclosure.

As a result of these and other concerns in the industry, efforts continued in an attempt to devise a practical and commercially feasible resealable container that was particularly adapted for packaging of sensitive and/or perishable items. U.S. Pat. No. 6,056,141 describes a reclosable packing system that remedies many of the previously noted shortcomings of other resealable container and lid assemblies. The '141 patent is directed to flexible multilayer lid sheets that are initially thermally bonded to a corresponding tray or container, can be opened by removing a portion of the multilayer lid sheet to thereby expose a region of pressure sensitive adhesive carried in the sheet, and which also utilize a barrier film in the multilayer lid sheet to improve sealing characteristics of the container.

Although providing an advance in the art, the reclosable packing system of the '141 patent is relatively complex, providing up to ten (10) layers in the lid sheet assembly and up to five (5) layers in the corresponding tray assembly. It is likely that such complex assemblies would be difficult and costly to manufacture. Furthermore, the use of such a large number of layers in a multilayer lid sheet, increases the susceptibility of malfunction of the lid sheet upon initial opening by a consumer. Tearing or rupturing of the lid sheet at any location other than the intended location along the layer of the pressure sensitive adhesive, would render the lid useless and thereby destroy the reclosing function of the assembly. Accordingly, a need remains in the packaging and container arts for a resealable assembly having excellent barrier properties, and a relatively simple construction for ease in manufacturing and reliability.

In packaging food items, a disadvantage typically associated with securely sealed containers, and most notably those with high barrier characteristics, is the difficulty in initially opening the container. Even with purportedly resealable containers such as used in packaging lunchmeat and other sensitive items, it is often very difficult to open the container. If a consumer is unable to readily open or "peel" the lid or sheet away from the container, resort to scissors or other utensils is made, again, resulting in destruction of the resealing feature. Accordingly, a need remains in the art for a resealable container assembly with high barrier properties, and which is relatively simple in construction and manufacture, and which can be easily opened by a consumer.

SUMMARY OF THE INVENTION

The difficulties and drawbacks associated with previous systems and methods are overcome by the present invention for a resealable package assembly. In a first aspect of the invention, the package assembly comprises a container and a unique multilayer laminate cover. The container and the cover are adapted to sealingly engage one another. The container includes a polymeric substrate defining a sealing face, and a first sealing layer disposed on the sealing face of the substrate. The cover defines an outer face and an inner face. The inner face is directed towards the sealing face of the substrate upon sealingly engaging the container and the cover to one another. The cover includes an outer substrate providing the outer face of the cover, an inner substrate, a adhesive layer disposed between the outer substrate and the inner substrate, a second sealing layer disposed on the inner substrate, the second sealing layer providing the inner face of the cover, and, optionally, a release layer disposed between the inner substrate and the adhesive layer, and immediately adjacent to the adhesive layer. In a further embodiment, the adhesive layer is a pressure sensitive adhesive layer.

In another aspect of the present invention, a method for opening and resealing a previously thermally sealed package is provided. The package comprises a container component and a cover component. The container component includes a polymeric substrate defining a sealing face, and a first sealing layer disposed on the sealing face of the container substrate. The cover component defines an outer face and an inner face, the inner face directed towards the sealing face of the container substrate. The cover includes an outer substrate providing the outer face of the cover, an inner substrate, a adhesive layer which may be a pressure sensitive adhesive layer, disposed between the outer substrate and the inner substrate, a second sealing layer disposed on the inner substrate, the second sealing layer providing the inner face of the cover, and, optionally, a release layer disposed between the inner substrate and the adhesive layer and contacting the adhesive layer. The container component and the cover component are thermally adhered to one another along the first and second sealing faces. The method comprises disengaging a first portion of the cover component from a remaining second portion of the cover component and container component thermally adhered thereto, by separating the adhesive layer from the inner substrate, or from the release layer, if present, to thereby open the package. The method also comprises matingly contacting the adhesive to the inner substrate, or to the release layer, if present, to thereby reseal the package.

As will be realized, the invention is capable of other and different embodiments and its several details are capable of modifications in various respects, all without departing from the invention. Accordingly, the drawings and description are to be regarded as illustrative and not restrictive.

DETAILED DESCRIPTION OF THE EMBODIMENTS

Figure 1:
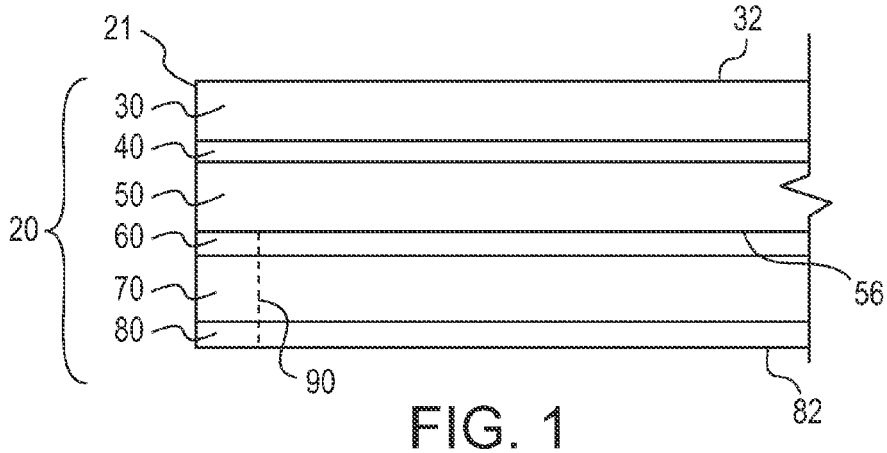
FIG. 1 is a schematic partial view of a preferred cover laminate used in a preferred embodiment package assembly in accordance with the present invention.

The present invention provides a resealable package assembly having high barrier properties, which is relatively simple in construction and manufacture, and which can be readily initially opened and securely resealed. In a first preferred embodiment, the package assembly comprises a cover assembly and a container which can be securely bonded to one another, such as by thermal bonding to thereby initially seal the interior of the container and its contents. The cover is a multilayer laminate which after being bonded or otherwise sealed to the container, can be readily opened by at least partially separating the cover into two portions along a designated interface within the laminate to reveal a region of adhesive in a first cover portion. The other cover portion remains bonded to the container and includes a region of an inner substrate or of a release layer, if present, exposed as a result of the cover separation. The two cover portions can then be remarried and contacted with one another to thereby effectively reseal the container. The configuration of the exposed region of the adhesive corresponds to, and preferably matches, the configuration of the exposed region of the inner substrate or release layer, if present.

One embodiment of the present invention includes the incorporation of a release layer within the multilayer laminate of the cover, and preferably immediately adjacent to the pressure sensitive adhesive layer. As explained in greater detail herein, the use of a release layer in the cover laminate significantly reduces the amount of force otherwise required to initially open a sealed container when certain adhesives or films are used. This feature promotes ease of use of a package system. The incorporation of a release layer as described herein also provides a designated rupture or separation interface between portions of the cover during initial opening of a sealed container. The provision of such a separation interface reduces the occurrence of tearing or unintended severing of the cover, thereby preserving the sealing integrity of the cover. These and other advantages of the preferred embodiment cover laminates and package assemblies are described in greater detail herein.

For ease in understanding the preferred embodiment package assembly, each of the various components in a representative cover and container of the assembly are described as follows.

Cover

The term "cover" as used herein refers to any multilayer laminate that is used to overlay one or more openings or apertures defined in a corresponding container, and which can be effectively secured to the container to thereby enclose and seal the interior of the container. Preferably, the cover laminate comprises (without regard to any order of the layers) an outer substrate, a barrier material layer, a adhesive layer, an optional release layer (which may be pressure sensitive), an inner substrate, and a heat sealing layer. An optional printing layer may also be used. Each of these layers within the preferred multilayer cover laminate is described as follows.

Cover Outer Substrate

The preferred multilayer cover laminate includes an outer substrate to provide support for the cover and particularly for an outermost portion of the cover resulting from initial opening of the container and thus at least partial separation of the cover. The outer substrate can be formed from a wide array of materials such as polyethylene terephthalate film, polyolefin film materials or paper, cardboard, or other paper-based materials. Representative materials for the outer substrate include, but are not limited to, polyethylene terephthalate (PET), polyethylene (PE), polypropylene (PP), both oriented and nonoriented, and copolymers thereof. Another example of a potentially suitable film for the cover outer substrate is a layer of polyvinyl chloride (PVC) and copolymers thereof. Additional materials include, but are not limited to, polyvinyl chloride (PVC), and ortho-phthalaldehyde (OPA). For many applications, PET is preferred.

The cover outer substrate can be utilized at various thicknesses in the cover laminate. The outer substrate can have a typical thickness of from about 12 to about 60 microns, and a preferred thickness of from about 12 to about 25 microns.

Since the outer face of the outer substrate will likely constitute the outermost surface of the cover, it is desirable that the material selected for the outer substrate, at least along this outwardly directed face, exhibit attractive printability characteristics.

Printability is typically defined by the sharpness and brightness of the image and by ink anchorage. The sharpness is closely related to the surface tension of the print surface. The ink anchorage is often tested by a tape test (Finat test: FTM21). In general, PVC is printable with a variety of inks intended to be used with PVC. In most occasions the inks are water-based (especially in the US) or designed for UV drying (especially in Europe). In general, all polyolefin films can be printed with UV inks after on-press corona treatment, PE being better than PP mainly on ink adhesion. For waterbased inks an additional primer or topcoat is preferred to achieve good ink anchorage.

As explained herein, the cover laminate may include an optional printing layer disposed on an outer face of the cover or below the outer substrate on an inner surface of the outer substrate.

Cover Barrier Material Layer

According to one embodiment, the preferred multilayer cover laminate includes a barrier material layer to promote the sealing characteristics of the cover and resulting sealed cover and container assembly. Typically, it is desirable for the barrier material to exhibit resistance to oxygen transport or diffusion through the material. This is particularly desirable for sealing applications involving certain foods. A wide range of barrier materials can be used for the barrier material layer. The selection of the barrier material(s) is largely dictated by the degree of sealing required and hence, by the contents for which the sealing assembly is to house. Representative materials for use in the barrier material layer include, but are not limited to, polyvinyl alcohol (PVOH) and ethylene vinyl alcohol (EVOH) polymers. A well known and preferred barrier material is polyvinylidene chloride (PVDC). It is also contemplated that nylon and various nylon-based polymers known in the art could be used. It is further contemplated that combinations of these materials could be used, and in particular, multiple films of these materials could be utilized. An excellent discussion of barrier materials and their characteristics is provided in US Patent Application Publication 2004/0033379, owned by the assignee of the present application. Preferred materials for the barrier material include PVDC, PVOH, EVOH, and combinations thereof.

The barrier material is typically utilized at relatively small thicknesses in the preferred cover laminate. For example, the barrier material layer thickness is preferably from about 1 to about 5 microns, and preferably from about 1 to about 3 microns in thickness.

As noted, preferably the barrier material exhibits relatively low oxygen permeability. Preferred maximum oxygen permeability is approximately 50 $cc/m^2/24$ hours. Most preferably, the oxygen permeability is 0.5 to 7 $cc/m^2/24$ hours.

For certain applications, it is contemplated that the cover laminate of the present invention can be free of a barrier layer. However, the preferred embodiment includes a barrier layer.

Cover Adhesive Layer

The preferred multilayer cover laminate includes an adhesive layer. In one embodiment, the adhesive layer is a pressure sensitive adhesive layer and the adhesive provides a tacky surface allowing a bond to another contacting surface. Preferably, the properties of the adhesive are such that the bond also provides a seal to prevent or at least significantly prevent the flow of air or other agents across the region of the adhesive. The adhesive layer may be a single adhesive layer or may be a multilayer adhesive.

A wide range of adhesives can be used in this layer so long as their properties and characteristics are consistent with the packaging requirements of the resulting assembly. The adhesive could be a hot melt pressure sensitive adhesive, such as for example a rubber-based or acrylic-based pressure sensitive adhesive. The adhesive could be a UV cured hot melt. The adhesive could be based on a rubber-based hot melt composition, a solvent rubber adhesive, a solvent acrylic adhesive, or a solvent polyurethane adhesive. The adhesive could be emulsion-based such as an emulsion acrylic adhesive. As noted, a wide array of adhesives could be used. Each of the aforementioned adhesives are preferably in the form of PSA's. An extensive selection of various pressure sensitive adhesives are disclosed in U.S. Pat. Nos. 5,623,011; 5,830,571; and 6,147,165; owned by the assignee of the present application, and incorporated herein by reference.

A preferred pressure sensitive adhesive for use in the pressure sensitive adhesive layer is commercially available under the designation Fasson® S692N. The S692N adhesive is an acrylic emulsion based adhesive. Generally, this adhesive is a polymeric blend of butyl acrylate and 2-ethyl-hexyl acrylate monomers with various tackifiers and processing acids. Other preferred pressure sensitive adhesives include, but are not limited to, emulsion acrylic adhesives and rubber-based hot melt adhesives.

The thickness of the pressure sensitive adhesive layer typically ranges from about 3 to about 40 microns and preferably from about 12 to about 20 microns. It will be understood however that the present invention includes cover laminates using thicknesses greater than or lesser than these thicknesses for the pressure sensitive adhesive layer.

Cover Release Layer

In accordance with another embodiment of the invention, the multilayer cover laminate includes a release layer. Preferably, the release layer is disposed immediately adjacent to the pressure sensitive adhesive layer in the cover laminate. Most preferably, the release layer is disposed between the pressure sensitive adhesive layer and the inner substrate. The release layer provides a release surface which, as previously noted, is immediately adjacent to, and in contact with, the pressure sensitive adhesive layer.

A wide variety of release materials such as those typically used for pressure sensitive tapes and labels are known, including silicones, alkyds, stearyl derivatives of vinyl polymers (such as polyvinyl stearyl carbamate), stearate chromic chloride, stearamides and the like. Fluorocarbon polymer coated release liners are also known but are relatively expensive. For most pressure sensitive adhesive applications, silicones are by far the most frequently used materials. Silicone release coatings have easy release at both high and low peel rates, making them suitable for a variety of production methods and applications.

Known silicone release coating systems consist of a reactive silicone polymer, e.g., an organopolysiloxane (often referred to as a "polysiloxane," or simply, "siloxane"); a cross-linker; and a catalyst. After being applied to the adjacent layer or other substrate, the coating generally must be cured to cross-link the silicone polymer chains, either thermally or radiatively (by, e.g., ultraviolet or electron beam irradiation).

Based on the manner in which they are applied, three basic types of silicone release coatings used in the pressure sensitive adhesive industry are known: solventborne, waterborne emulsions, and solvent free coatings. Each type has advantages and disadvantages. Solventborne silicone release coatings have been used extensively but, because they employ a hydrocarbon solvent, their use in recent years has tapered off due to increasingly strict air pollution regulations, high energy requirements, and high cost. Indeed, the energy requirements of solvent recovery or incineration generally exceed that of the coating operation itself.

Waterborne silicone emulsion release systems are as well known as solvent systems, and have been used on a variety of pressure sensitive products, including tapes, floor tiles, and vinyl wall coverings. Their use has been limited, however, by problems associated with applying them to paper substrates. Water swells paper fibers, destroying the dimensional stability of the release liner backing and causing sheet curling and subsequent processing difficulties.

Solventless silicone release coatings have grown in recent years and now represent a major segment of the silicone release coating market. Like other silicone coatings, they must be cured after being applied to the flexible liner substrate. Curing produces a cross-linked film that resists penetration by the pressure sensitive adhesive.

Informative descriptions of various release materials, their characteristics, and incorporation in laminate assemblies are provided in U.S. Pat. Nos. 5,728,469; 6,486,267; and US Published Patent Application 2005/0074549, owned by the assignee of the present application. It is also contemplated that various waxes known in the art could be used for the release material or utilized in the release layer.

The preferred cover laminates utilize release layers that are relatively thin. For example, a typical release layer thickness is from about 1 to about 4 microns. Preferably, the thickness of the release layer is from about 1 to about 2 microns.

Cover Inner Substrate

The preferred multilayer cover laminate includes an inner substrate. The inner substrate provides support for the cover laminate and particularly for the layers disposed adjacent to the inner substrate. Representative materials for the inner substrate include those noted herein for the outer substrate. In addition, it may be preferred to utilize a biaxially-oriented polypropylene (BOPP) material. These materials provide cost savings as they are relatively inexpensive, and they have sufficient stiffness to dispense well. Another preferred material for use in the inner substrate layer is polyethylene terephthalate (PET). The previously noted PVC and OPA polymeric materials may also be suitable for use in this layer.

The inner substrate thickness typically ranges from about 12 to about 60 microns, and preferably from about 12 to about 25 microns. The present invention includes the use of thicknesses greater than or lesser than these thicknesses.

Optionally, the inner substrate can incorporate a slip agent therein or thereon. The slip agent, when incorporated as a separate coating, can be very thin, preferably around 1 micron in thickness and can comprise, for example, silicon based slip agents.

Cover Heat Sealing Layer

The preferred multilayer cover laminate includes a heat sealing layer. Preferably, the heat sealing layer is disposed along the underside or inner face of the cover laminate that contacts a corresponding face of the container upon thermal bonding of the cover to the container.

The heat sealing layer is a layer which is activated by heat to allow the layer to bond to a plastic substrate. Materials for the heat sealing layer include, but are not limited to, the following film-forming materials used alone or in combination such as polyethyelene, metallocene catalyzed polyolefins, syndiotactic polystyrene, syndiotactic polypropylene, cyclic polyolefins, polyethylene methyl acrylic acid, polyethylene ethyl acrylate, polyethylene methyl acrylate, acrylonitrile butadiene styrene polymer, polyethylene vinyl alcohol, polyethylene vinyl acetate, nylon, polybutylene, polystyrene, polyurethane, polysulfone, polyvinylidene chloride, polypropylene, polycarbonate, polymethyl pentene, styrene maleic anhydride polymer, styrene acrylonitrile polymer, ionomers based on sodium or zinc salts of ethylene/methacrylic acid, polymethyl methacrylates, cellulosics, fluoroplastics, polyacrylonitriles, and thermoplastic polyesters. Preferably, PE is used in the heat sealing layer, more preferably, a blend of PE and EVA, such as for example, a blend of PE and EVA with special antiblock and antistatic additives. Another preferred material for use in the heat sealing layer is glycol-modified polyethylene terephthalate (PETG). A most preferred material for the heat sealing layer is linear low density polyethylene (LLDPE).

The thickness of the heat sealing layer may vary according to requirements of the packaging assembly. Typical thicknesses of this layer are from about 15 to about 90 microns and preferably from about 30 to about 60 microns.

The heat sealing layer is designed to be activated at temperatures known to those skilled in the art. While the heat sealing layer may activate at temperatures below those specified for activation, the heat sealing layer is designed to activate at certain temperatures based on the substrate material. Preferably, the heat sealing layer activates at temperatures between about 90° C. to about 150° C., more preferably the heat sealing layer activates at temperatures between about 110° C. to about 140° C., and most preferably the heat sealing layer activates at temperatures between about 120° C. to about 130° C. Preferably, pressure is also applied to the respective surfaces during heat sealing.

Cover Printing Layer

An optional printing layer may be disposed on the previously described cover outer substrate. The printing layer serves to receive and retain one or more inks deposited on the printing layer. The ink(s) constitute indicia or other markings for the cover laminate and package assembly. The printing layer can be formed from a wide range of materials typically known to those skilled in the art. For example, a variety of polyvinyl alcohol (PVA) and cellulose-based materials can be used for the printing layer.

The printing layer typically ranges from about 3 to about 20 microns in thickness and preferably, from about 3 to about 8 microns in thickness.

Preferred Aspects of the Cover

Another significant feature of the preferred embodiment cover laminate is the provision of a cut, score, or slit in at least the heat sealing layer of the cover. Preferably, the cut, score, or slit extends through the heat sealing layer, the inner substrate of the cover laminate and the release layer. The cut, score, or slit, which can be a solid die cut or perforated die cut, preferably extends at least partially and more preferably about the entire periphery of the cover so as to correspond to a peripheral region defined about the container opening. The cut greatly facilitates initial opening of a sealed package. As explained in greater detail herein, the cut is preferably located at a location on the cover laminate inward of a heat sealing region between the cover and container. When opening a sealed package, the cover laminate is separated into two portions, an outer separable portion and an inner separable portion. The separation of these portions from one another occurs along an interface generally defined between the pressure sensitive adhesive layer and the release layer. The cut provides that separation occurs only in regions of the cover adjacent the heat sealing regions. Separation does not occur in other regions of the cover laminate. As a result, upon initially opening the sealed package, as the cover laminate is pulled from its sealed position, separation of the cover only occurs along the outer periphery of the container (and cover) to thereby expose the pressure sensitive adhesive and the release layer. The middle region of the cover does not separate and so is pulled from the container to thereby provide access to the interior of the container. The provision of the cut, score, or slit enables the outer separable cover portion to separate from the inner cover portion that remains thermally bonded to the container. The cut, score or slit can be formed in the cover laminate in a variety of ways, however, a preferred method is to die cut the slit through the sealing layer, inner substrate, and release layer.

It is also contemplated that by not forming the cut, score or slit in select regions of the cover laminate, a hinge or bridging cover portion can be provided. Thus, for example, the cut could be provided along three of four sides of a rectangular shaped cover that is subsequently sealed to a container. The side of the cover free of the cut would then serve as a hinge upon initial and later openings of the container.

Another reason for the preferred provision of the cut, score or slit in the noted layer(s) of the cover laminate, is that such a cut enables control of the contact surface area between the pressure sensitive adhesive layer and the release layer. The ability to readily control the amount, configuration, and shape of the contact area enables direct control over the resealing strength between the outer separable portion of the cover and the inner separable portion of the cover. As will be appreciated, for applications in which greater resealing strength is desired, the contact area can be readily increased during design and/or manufacturing. And for applications in which less resealing strength is desired, the contact area can be easily reduced in design and/or manufacturing.

Another preferred aspect of the preferred embodiment cover laminate is that by appropriate selection of the materials that the pressure sensitive adhesive contacts, i.e. the material layers disposed immediately adjacent to the pressure sensitive adhesive in the cover laminate, the surface energy of the exposed face of each material layer can be tailored to provide desired sealing characteristics such as particular resealing strengths. For example, if a low resealing strength is desired, a release material having a relatively low surface energy such as a silicone release material could be used immediately adjacent to the pressure sensitive adhesive layer. Furthermore, selection and arrangement of appropriately engineered materials for use in the layers immediately adjacent to the pressure sensitive adhesive could be used to achieve differences in tack to ensure or at least promote, retention of the adhesive with one layer as compared to another layer. For example, by appropriate selection and use of materials for the release layer and the layer disposed on an opposite face of the pressure sensitive adhesive layer, retention of the adhesive with the outer separable cover portion as opposed to remaining on the inner cover portion bonded to the container can be achieved.

Specifically, in accordance with the present invention, the level of adhesion between the pressure sensitive adhesive and one or more layer(s) immediately adjacent the adhesive, e.g. the release layer, is controlled. The level of adhesion is preferably controlled by (i) the use of a release layer disposed immediately adjacent to the pressure sensitive adhesive layer and most preferably disposed between the adhesive layer and the inner substrate in the cover laminate; (ii) the configuration and surface area of the release layer exposed after initial opening of the cover; (iii) appropriate selection of release materials and/or materials having desired surface energies used in the release layer; (iv) appropriate selection of other materials in the cover laminate, namely the pressure sensitive adhesive material and the material of the layer disposed immediately adjacent the face of the pressure sensitive adhesive opposite that of the release layer; (v) the configuration and surface area of the pressure sensitive adhesive material exposed after initial opening of the cover; and (vi) the thickness of the pressure sensitive adhesive layer.

By controlling the level of adhesion, preferably by one or more, or all of factors (i)-(vi), the pressure sensitive adhesive layer can be more reliably retained with the outer separable portion of the cover.

This strategy of the preferred embodiment cover laminates described herein provides a significant advantage over prior art cover assemblies and specifically, the reclosable packing system that is described in the previously addressed U.S. Pat. No. 6,056,141. The packing system of the '141 patent uses a "repositionable" adhesive. Thus, in that type of system, the adhesive is retained with a portion of the lid due to the adhesive being repositionable with respect to an underlying support film. The system of the '141 patent does not rely upon any other strategy for ensuring or at least attempting to keep the adhesive with the removable lid portion. Reliance solely upon the properties of the pressure sensitive adhesive severely limits the range of applications of the resulting packing system.

It is preferred that particular tack and peel characteristics exist with regard to the pressure sensitive adhesive and the layers disposed on opposite sides or faces of the pressure sensitive adhesive layer. It is desirable that a difference regarding these characteristics exists between the two layers on opposite sides of the pressure sensitive adhesive layer. Specifically, it is desired that a particular minimum difference exists between the tack and peel characteristics associated with (i) the pressure sensitive adhesive and the layer immediately adjacent to one face of the adhesive, and (ii) the pressure sensitive adhesive and the layer immediately adjacent to an opposite face of the adhesive.

Figure 9:
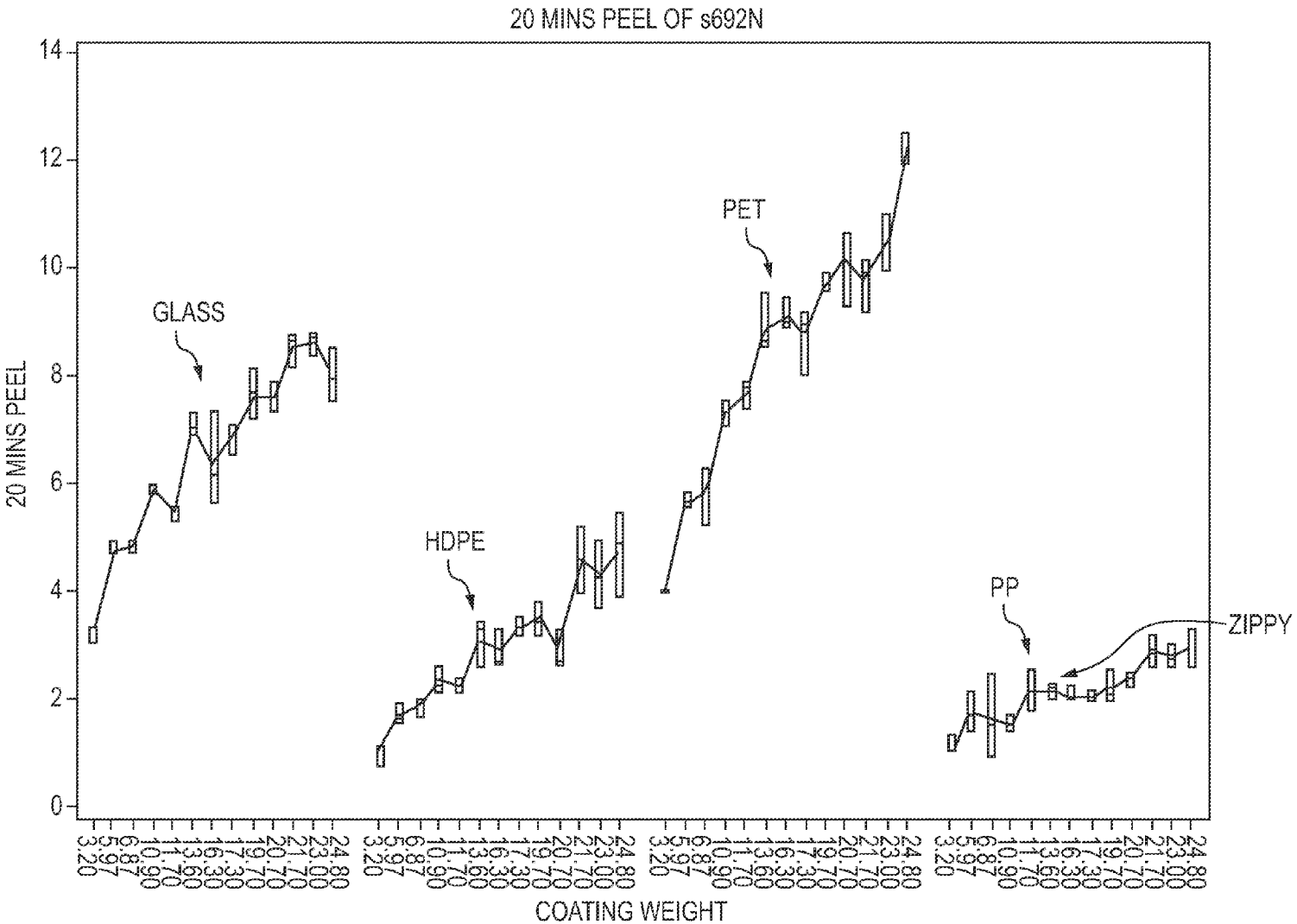
FIG. 9 is a graph illustrating results of peel strength tests for a preferred pressure sensitive adhesive and several contacting substrates.
Figure 10:
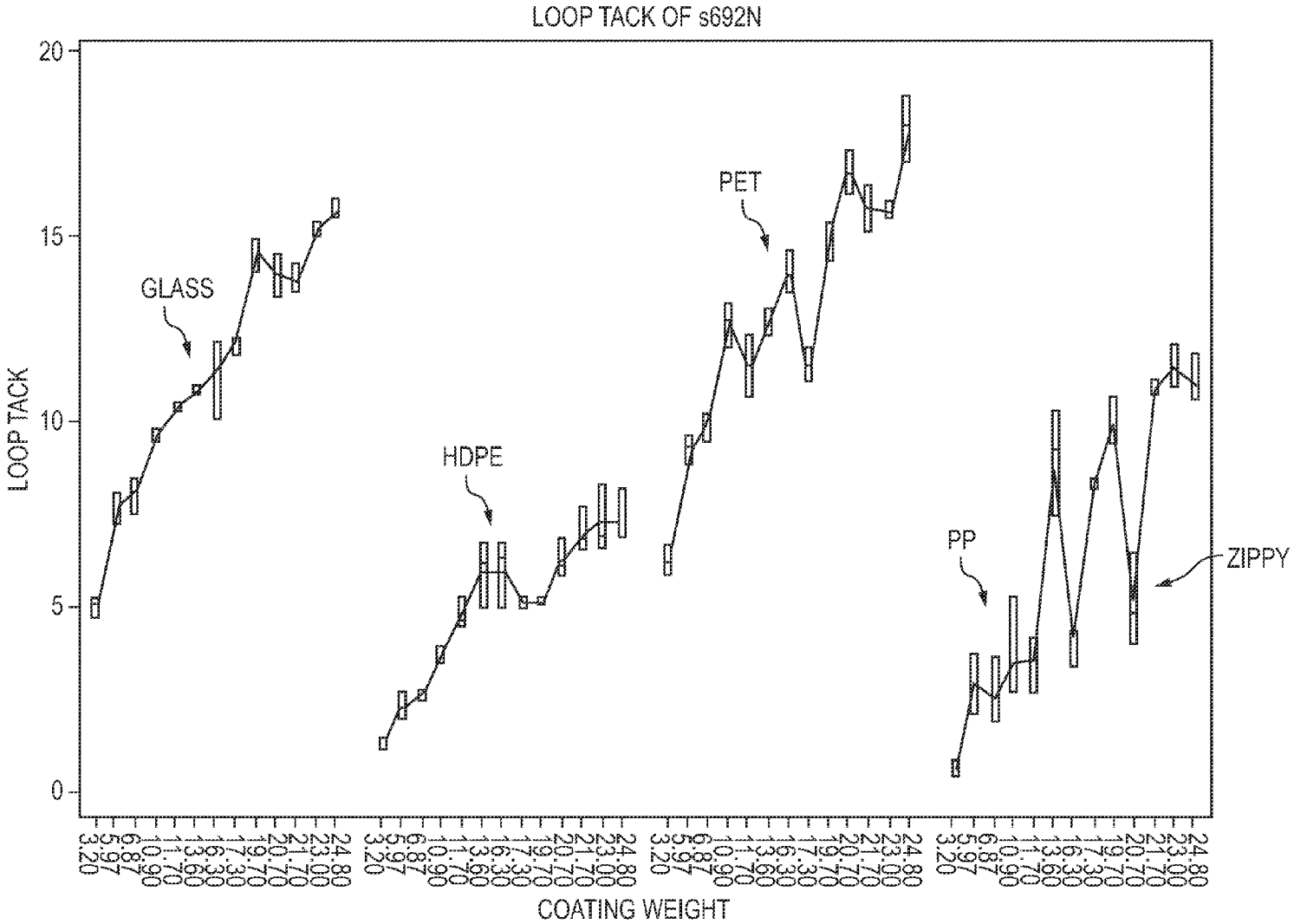
FIG. 10 is a graph illustrating results of loop tack tests for the preferred pressure sensitive adhesive and several contacting substrates.

For a cover laminate utilizing a pressure sensitive adhesive layer disposed between an inner substrate of biaxially oriented polypropylene (BOPP) and an outer substrate of polyethylene terephthalate (PET), it is preferred that the difference in tack and peel characteristics between these two substrates and a respective face of the pressure sensitive adhesive, be at least 1.5 N/in and preferably at least 3.0 N/in. The greater adhesive bond preferably exists between the outer substrate and a corresponding face of the pressure sensitive adhesive as compared to the adhesive bond existing between the inner substrate and an opposite face of the pressure sensitive adhesive. Referring to FIGS. 9 and 10, both peel and loop tack for a preferred pressure sensitive adhesive commercially available under the designation Fasson® S692N, exhibit a difference of greater than 3 N/in when comparing adhesion between an outer substrate of PET and an inner substrate of BOPP. This ensures that the pressure sensitive adhesive remains with the outer substrate when the cover laminate is at least partially separated along a separation interface, upon opening of the cover and container assembly.

Appropriate selection of the pressure sensitive adhesive and the release layer material primarily governs the force needed to initially open a sealed container, and also the amount of force necessary for subsequent opening operations after an initial opening. This force, referred to as the "opening force," is the force that a consumer must exert upon the cover in order to separate the cover laminate into its respective portions and thereby open the container. Typically, to provide a relatively easy to open container, the opening force should be less than 15 N/in. Also, it is desirable that some minimum force be necessary so as to prevent unintended openings of the container. Thus, typically, a minimum force of at least 2 N/in and preferably greater than 3 N/in is targeted.

Referring further to the previously noted U.S. Pat. No. 6,056,141, the lid assembly can use a layer of polypropylene (PP) as a support film along an upper face of the adhesive. This construction would almost certainly result in adhesive remaining on a lower support layer, along an opposite face of the adhesive. It is well known in the art that polypropylene films typically exhibit relatively low surface energies, and hence would not provide sufficient bond with the adhesive. Thus this construction would not retain the adhesive with the lid. As will be appreciated, this is undesirable since adhesive existing on a lower support layer, i.e. on the container, significantly increases the likelihood of contact between food and the adhesive.

By utilization of these key aspects, potentially with other features of the preferred embodiment cover laminate as described herein, very specific adhesion, resealing, and opening characteristics of the cover laminate can be achieved.

Container

The term "container" as used herein refers to an enclosure, housing, or package that provides an interior hollow region within which, food or other items can be stored. The interior of the container can be accessible through one or more apertures or openings defined in the container, such as in a wall of the container. Alternately, the container can be formed, preferably from a relatively rigid shape-retaining material such that the container defines a recessed open interior region that is accessible through an opening or other access means formed in the container. The preferred forms of the container in accordance with the present invention exhibit one or more relatively rigid walls formed and/or arranged about an opening that provides unobstructed access to the interior of the container.

Preferably extending about the periphery of the container opening, is a lip or other structural member that defines a region for contacting and sealing with the previously described cover. Preferably, a layer of a heat sealing material is disposed along a face or at least a region of the face of the lip for subsequent contact with the heat sealing layer of the cover laminate during thermal bonding between the cover and container.

Although the preferred form of the container is a rigid wall receptacle having the previously described lip, the present invention includes the use of flexible wall enclosures such as a bag, pouch, or packet.

Container Heat Sealing Layer

Preferably, the heat sealing layer of the container utilizes the same or a suitably compatible material as the previously described heat sealing layer for the cover.

Container Substrate

The container includes a substrate that preferably provides the overall structure, strength, and shape of the container. A wide range of materials known in the art can be used for the container. The selection of the particular material largely depends upon the particular application and sealing requirements for the container assembly.

Preferred Embodiment Package Assembly

FIG. 1 is a schematic view of a preferred cover laminate 20 used in a preferred embodiment package assembly in accordance with the present invention. The preferred cover laminate 20 comprises an outer substrate 30, an optional barrier material layer 40, a pressure sensitive adhesive layer 50, a release layer 60, an inner substrate 70, and a heat sealing layer 80. The outer substrate 30 defines an outer face 32 which can receive printing or other identifying indicia. The heat sealing layer 80 defines a lower face 82 for subsequent contact with a container during a sealing operation. A cut, score, or slit 90 extends through or at least partially through the heat sealing layer 80. The cut, score, or slit preferably extends entirely through layer 80, and the inner substrate 70, and the release layer 60. A separation interface 56 is defined between the pressure sensitive adhesive layer 50 and the release layer 60. As previously explained herein, upon opening of the container, the cover laminate 20 separates along this interface within the regions of the cover 20 that are adjacent the regions at which the heat sealing layer 80 is thermally bonded to a container (not shown in FIG. 1). The cover 20 also defines one or more outer edges 21 described in greater detail herein.

Figure 2:
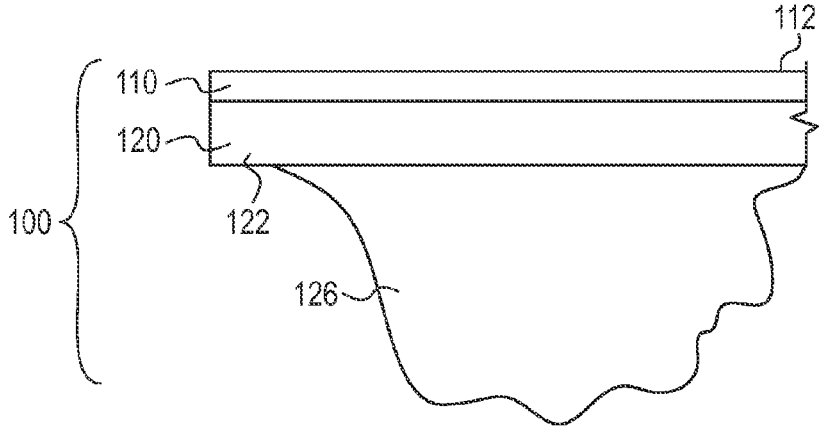
FIG. 2 is a schematic partial view of a preferred container used in the preferred embodiment package assembly of the present invention.

FIG. 2 is a schematic view of a preferred container 100 used in the preferred embodiment package assembly of the present invention. The container 100 comprises a heat sealing layer 110, and a substrate 120 that includes a lip 122 and one or more walls 126. The heat sealing layer 110 defines an upper face 112 for subsequent contact with a cover, and more particularly, with the lower face 82 of the cover 20 shown in FIG. 1.

Figure 3:
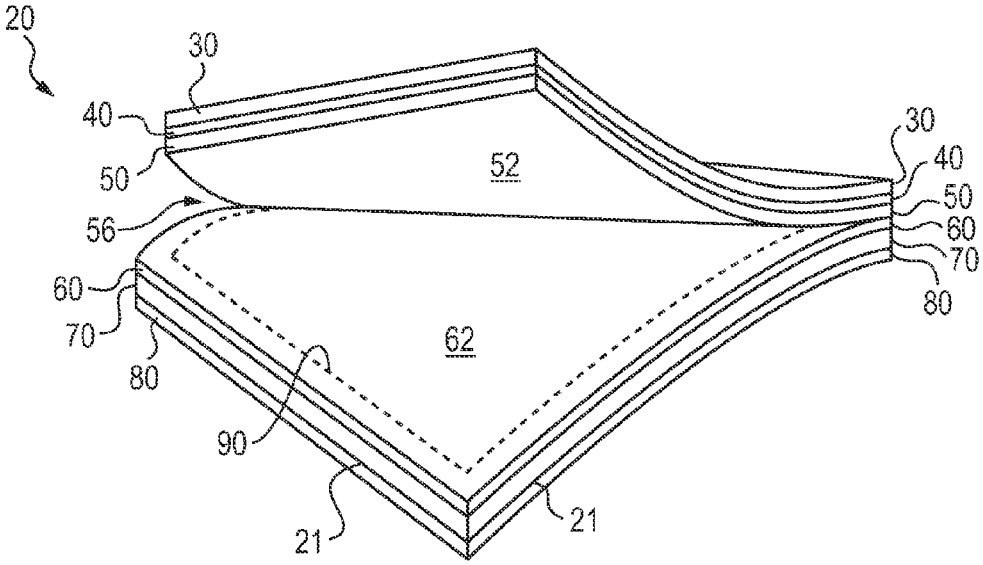
FIG. 3 is a schematic view of the preferred cover laminate illustrating partial separation of two portions of the cover.

FIG. 3 is a schematic view of the preferred cover laminate 20 prior to bonding or otherwise attaching to a container, in which the cover 20 is partially separated along the separation interface 56 to reveal a lower face 52 of the pressure sensitive adhesive layer 50 and an upper face 62 of the release layer 60. This figure illustrates a preferred configuration for the score 90 extending at least partially through the release layer 60, the inner substrate 70, and the heat sealing layer 80. Preferably, the score 90 extends along the outer periphery of the cover 20.

Figure 4:
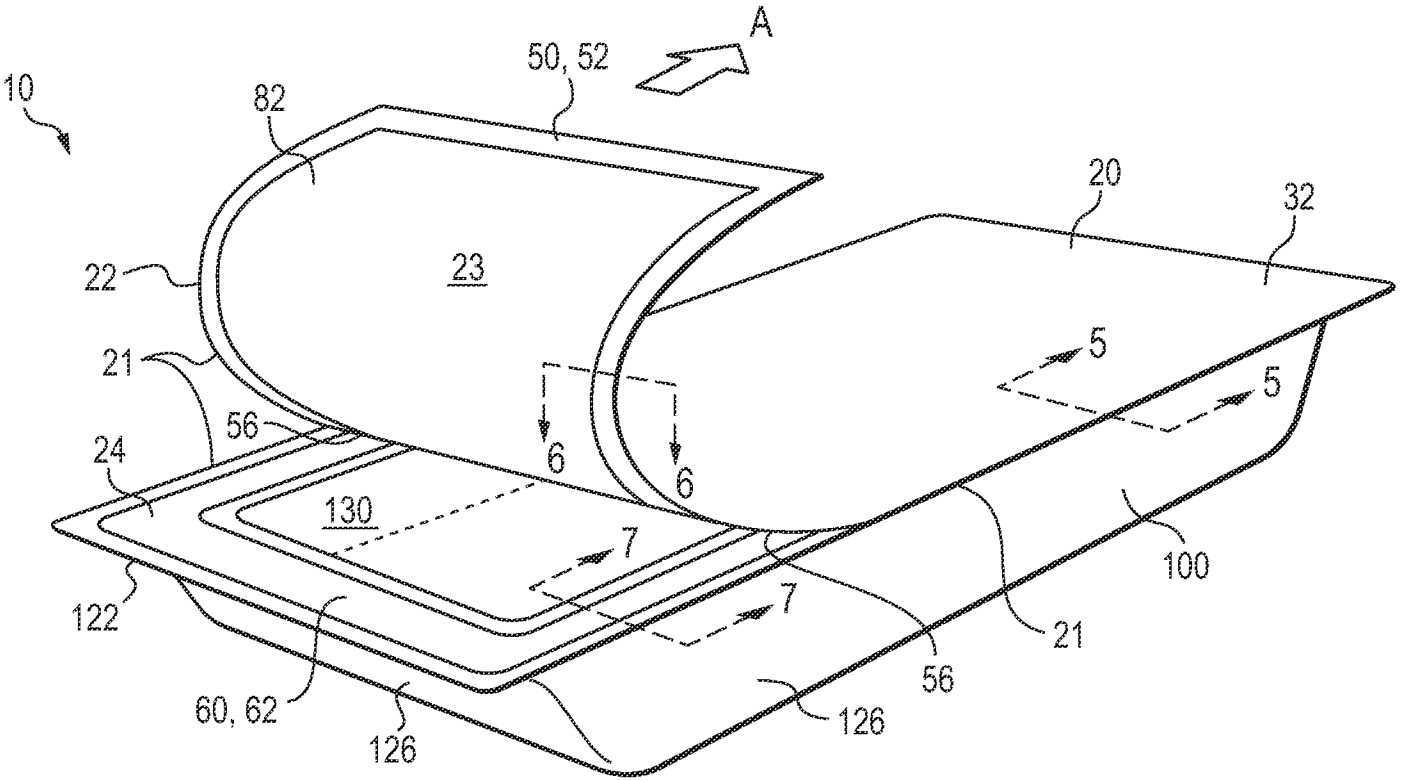
FIG. 4 is a perspective view of the preferred embodiment package assembly of the present invention.

FIG. 4 is a perspective view of a preferred embodiment package assembly 10 including the cover 20 and the container 100. FIG. 4 illustrates the package 10 being opened, after the cover 20 and the container 100 have been thermally bonded to one another via their respective heat sealing layers 80 and 110 (see FIGS. 1 and 2, respectively) along the lip 122 of the container 100. The package 10 is opened by pulling an end or portion of the cover 20 in the direction of arrow A, thereby separating the cover 20 into two portions. An inner separable portion 24 remains thermally bonded to the lip 122 of the container 100. An outer separable portion 22 results, and its withdrawal from covering the container enables access to a container interior 130. Separation of the cover 20 into its portions 22 and 24 occurs along the separation interface 56 in the region of the cover between the score 90 and the outer edge 21 of the cover 20, shown in FIGS. 1, 3 and 4. Separation of the cover 20 does not occur in the interior region, shown in FIG. 4 as region 23. Upon cover separation, a region of the lower face 52 of the pressure sensitive adhesive 50 is exposed in the cover outer separable portion 22. And, a region of the upper face 62 of the release layer 60 is exposed in the cover inner separable portion 24.

Figure 5:
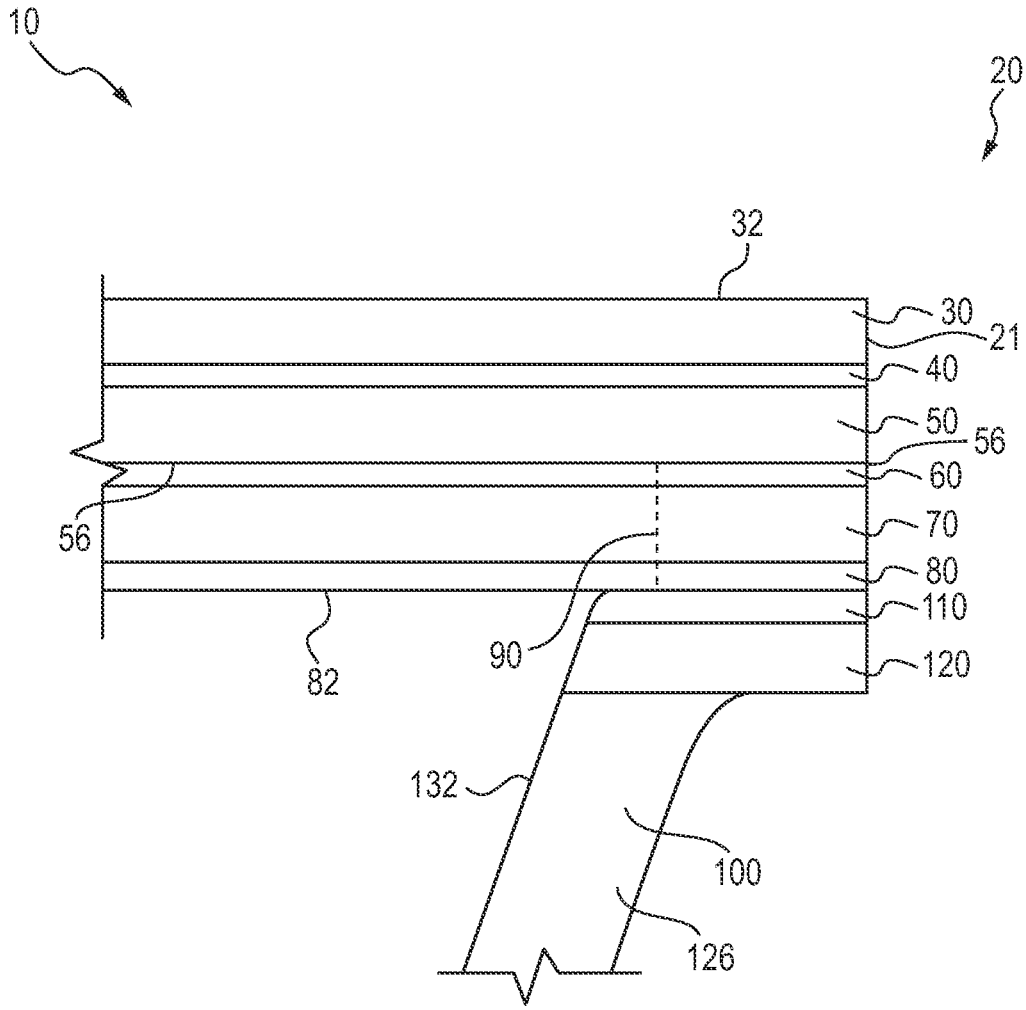
FIG. 5 is a partial cross sectional view of the package assembly taken along line 5-5 in FIG. 4.

FIG. 5 is a partial cross sectional view of the package assembly 10 taken along line 5-5 shown in FIG. 4. The view of FIG. 5 illustrates the configuration of the cover 20 and the container 100 after thermal bonding to one another and prior to initial opening of the sealed package 10. Specifically, heat sealing the cover 20 and the container 100 occurs along the interface between the heat sealing layers 80 and 110. FIG. 5 illustrates a heat sealing (or heat sealed) region generally extending between the score 90 and the outer edge 21 of the cover 20, and generally between the heat sealing layers 80 and 110.

Figure 6:
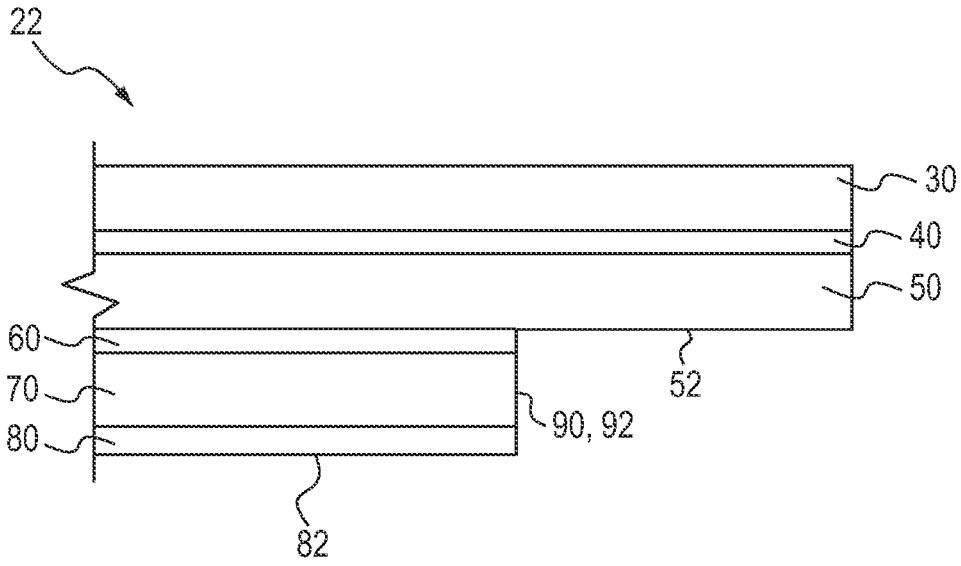
FIG. 6 is a partial cross sectional view of the package assembly taken along line 6-6 in FIG. 4.

FIG. 6 is a partial cross sectional view of the package assembly 10 taken along line 6-6 in FIG. 4. FIG. 6 illustrates the configuration of the cover outer separable portion 22 after the cover 20 is thermally bonded to the container 100 and after initial opening of the package 10. FIG. 6 also illustrates a first cut face 92 that is exposed along a laterally directed edge of the layers 60, 70, and 80 of the cover 20. The cut face 92 results from forming the previously described score 90 and is exposed upon separating the cover 20 into portions 22 and 24.

Figure 7:
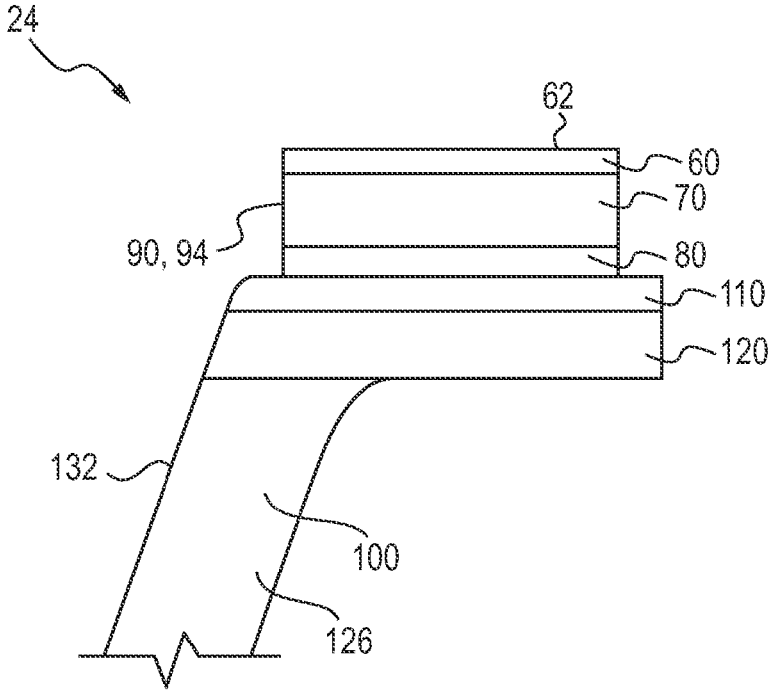
FIG. 7 is a partial cross sectional view of the package assembly taken along line 7-7 in FIG. 4.

FIG. 7 is a partial cross sectional view of the package assembly 10 taken along line 7-7 in FIG. 4. FIG. 7 illustrates the configuration of the cover inner separable portion 24 after the cover 20 is thermally bonded to the container and after initial opening of the package 10. The container 100 defines an interior surface 132. It is contemplated that one or more sealing, barrier, and/or food-compatible materials may be deposited or otherwise coated along this interior surface 132. FIG. 7 also illustrates a second cut face 94 that is exposed along a laterally directed edge of the layers 60, 70, and 80 of the cover 20. The cut face 94 results from forming the previously described score 90 and is exposed upon separating the cover 20 into portions 22 and 24.

Figure 8:
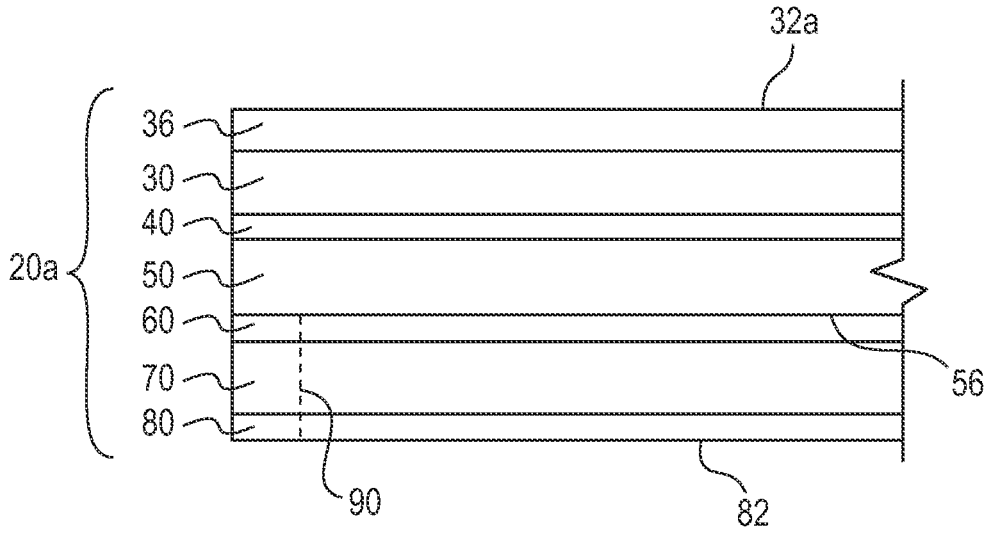
FIG. 8 is a schematic partial view of another preferred cover laminate used in a preferred embodiment package assembly in accordance with the present invention.

FIG. 8 is a schematic view of another preferred cover laminate **20*a* used in a preferred embodiment package assembly in accordance with the present invention. The preferred cover laminate 20*a* comprises a printing layer 36, an outer substrate 30, a barrier material layer 40, a pressure sensitive adhesive layer 50, a release layer 60, an inner substrate 70, and a heat sealing layer 80. The printing layer 36 defines an outer face 32*a* which can receive printing or other identifying indicia. The heat sealing layer 80 defines a lower face 82 for subsequent contact with a container during a sealing operation. A cut, score, or slit 90 extends through or at least partially through the heat sealing layer 80. The cut, score, or slit preferably extends entirely through layer 80, and the inner substrate 70, and the release layer 60. A separation interface 56 is defined between the pressure sensitive adhesive layer 50 and the release layer 60. As previously explained herein, upon opening of the container, the cover laminate 20 separates along this interface within the regions of the cover 20*a* that are adjacent the regions at which the heat sealing layer 80 is thermally bonded to a container (not shown in FIG. 8**).

Additional Preferred Aspects of the Cover and Container Assembly

Table 1 set forth below, lists additional preferred characteristics and features of the preferred package assembly. The characteristics and features are listed in order of importance. Items 1, 2, 6, and 11 are preferably achieved by appropriate selection of the materials used in the respective layer(s). Items 3, 4, 7, 8, 9, and 11 are preferably achieved by appropriate selection of the pressure sensitive adhesive and its characteristics and properties.

TABLE 1

Features of Preferred Package Assembly

| Item | Characteristic or Feature |
|---|---|
| 1 | Barrier Properties |
| 2 | Good permanent seal to package bottom |
| 3 | Indirect Food Contact (regarding adhesive) |
| 4 | Release from "reseal film" |
| 5 | Tamper Evidence/Security |
| 6 | Overprinting Quality (letter press, dot matrix, flexo) |
| 7 | Peel after delam/relam |
| 8 | Application Temp (5 deg C.-10 deg C.) |
| 9 | Service Temp (−5 to 30 deg C.) |
| 10 | Printing Speed |
| 11 | Laminate Clarity |
| 12 | Direct Food Contact (regarding adhesive) |

The present invention also provides a method for opening and resealing a previously thermally sealed package. The package comprises a container component and a cover component, as previously described herein. The method comprises separating a first portion of the cover component from a remaining second portion of the cover component and container component thermally adhered thereto. This results in separation of the pressure sensitive adhesive layer from the release layer in the heat sealed region(s) to thereby expose a region of the pressure sensitive adhesive and a corresponding region of the release layer. As cover separation does not occur elsewhere, such as in the interior region 23 of the cover 20 (see FIG. 4), the package is readily opened and the interior of the container becomes accessible. The method also comprises matingly contacting the exposed region of pressure sensitive adhesive to the exposed region of the release layer, to thereby reseal the package. The term "matingly contacting" refers to positioning the cover outer separable portion 22 having the exposed region of pressure sensitive adhesive, such that this region is aligned with the corresponding exposed region of release layer in the cover inner separable portion 24. Preferably, upon matingly contacting these regions to another, the entirety of each region is contacted with the other, or very nearly so.

The container component and the cover component are thermally adhered to one another by contacting a first sealing layer of the container component to the second sealing layer of the cover component. The method also includes heating the first and second sealing layers to a temperature of from about 120° C. to about 130° C. for a time period of at least 2 seconds.

EXAMPLES

Example 1

In a first series of investigations, peel tests were conducted in which the adhesive force of a preferred pressure sensitive adhesive, the previously noted Fasson® S692N, was measured relative to different substrates. Four different substrates were evaluated, glass, high density polyethylene (HDPE), polyethylene terephthalate (PET), and polypropylene (PP). The adhesive was applied to the respective substrates, at varying adhesive coat weights. The peel strength of the adhesive from the substrate was then measured. FIG. 9 illustrates peel strength values (in N/in) measured for each of the substrates containing varying amounts of the preferred adhesive (in gsm). As will be appreciated as the coating weight increased, the peel strength increased.

Example 2

In another series of investigations, loop tack of the preferred adhesive Fasson® S692N was measured in regard to the previously noted four substrates, glass, HDPE, PET and PP. FIG. 10 illustrates loop tack values (in N/in) measured for each of the substrates containing varying amounts of the adhesive (in gsm). As the coating weight increased, the loop tack increased.

As previously explained, differences in peel strength and loop tack between opposing faces of the pressure sensitive adhesive in the cover laminates can be utilized to achieve desired behavior of the cover upon separation and resealing characteristics. FIGS. 9 and 10 reveal that coating weight or thickness of the pressure sensitive adhesive in the cover laminate can also affect the peel strength and loop tack characteristics between the adhesive and each of the layers disposed immediately adjacent to the adhesive layer.

Additional details as to various components, manufacturing aspects, and construction of the preferred embodiment package assembly, and its cover laminate and container components are provided in U.S. Pat. No. 7,165,888, owned by the assignee of the present application.

Many other benefits will no doubt become apparent from future application and development of this technology.

All patents, published applications, test methods or standards, and articles noted herein are hereby incorporated by reference in their entirety.

As described hereinabove, the present invention solves many problems associated with previous type devices. However, it will be appreciated that various changes in the details, materials and arrangements of parts, which have been herein described and illustrated in order to explain the nature of the invention, may be made by those skilled in the art without departing from the principle and scope of the invention, as expressed in the appended claims.

What is claimed is:

1. A resealable package assembly, the package assembly comprising a container and a cover, the container and the cover adapted to sealingly engage one another, the container including:

a polymeric substrate defining a sealing face, and a first sealing layer disposed on the sealing face of the polymeric substrate;

wherein the cover defines an outer face and an inner face, the inner face directed towards the sealing face of the polymeric substrate upon sealingly engaging the container and the cover to one another, the cover including:

an outer substrate providing the outer face of the cover, an inner substrate, an adhesive layer disposed between the outer substrate and the inner substrate, a second sealing layer disposed on the inner substrate, the second sealing layer providing the inner face of the cover, and optionally a release layer disposed between the inner substrate and the adhesive layer, and immediately adjacent to the pressure sensitive adhesive layer; and a barrier layer disposed (i) between the inner substrate and the outer substrate, or (ii) on the second sealing layer of the inner substrate;

wherein the barrier layer exhibits an oxygen permeability of less than 50 $cc/m^2/24$ hours; and wherein the opening force of the cover is less than 15 N/in.

2. The resealable package assembly of claim 1 wherein the adhesive is a pressure sensitive adhesive.

3. The resealable package assembly of claim 1 wherein at least one of the first sealing layer and the second sealing layer comprises a material selected from the group consisting of linear low density polyethylene (LLDPE), polyolefin co-polymer and glycol-modified polyethylene terephthalate (PETG), and combinations thereof.

4. The resealable package assembly of claim 1 wherein the inner substrate comprises a material selected from the group consisting of oriented polypropylene (OPP), polyethylene terephthalate (PET), polyvinyl chloride (PVC), ortho-phthalaldehyde (OPA), and combinations thereof.

5. The resealable package assembly of claim 2 wherein the pressure sensitive adhesive layer comprises a polymeric blend of butyl acrylate and 2-ethyl-hexyl acrylate monomers.

6. The resealable package assembly of claim 1, including the release layer, wherein the release layer comprises silicone.

7. The resealable package assembly of claim 1 wherein the outer substrate comprises a material selected from the group consisting of polyethylene terephthalate (PET), polyethylene (PE), polypropylene (PP), polyvinyl chloride (PVC), ortho-phthalaldehyde (OPA), copolymers thereof, and combinations thereof.

8. The resealable package assembly of claim 1 wherein the barrier layer is disposed between the adhesive layer and the outer substrate.

9. The resealable package assembly of claim 1, wherein the barrier layer exhibits an oxygen permeability of 0.5 to 7 $cc/m^2/24$ hours.

10. The resealable package assembly of claim 1 wherein the barrier layer comprises a material selected from the group consisting of polyvinylidene chloride (PVDC), ethylene vinyl alcohol polymer (EVOH), polyvinyl alcohol (PVOH), nylon polymers, and combinations thereof.

11. The resealable package assembly of claim 1 wherein the opening force of the cover is from about 0.1 N/in to about 15 N/in.

12. The resealable package assembly of claim 1 wherein the cover is sealingly engaged to the container.

13. The resealable package assembly of claim 1 wherein the first sealing layer of the container is thermally adhered to the second sealing layer of the cover.

14. The resealable package assembly of claim 11 wherein a portion of the cover is removed from the container by separating the adhesive layer of the cover from the release layer of the cover.

15. The resealable package assembly of claim 1 further comprising:

a printing layer disposed on the outer substrate or below the outer substrate, wherein the printing layer provides the outer face of the cover.

16. A method for opening and resealing a previously thermally sealed package, the package comprising a container component and a cover component, wherein the container component includes a polymeric substrate defining a sealing face, and a first sealing layer disposed on the sealing face of the container substrate; wherein the cover component defines an outer face and an inner face, the inner face directed towards the sealing face of the container substrate, the cover including an outer substrate providing the outer face of the cover, an inner substrate, an adhesive layer disposed between the outer substrate and the inner substrate, a second sealing layer disposed on the inner substrate, the second sealing layer providing the inner face of the cover, a release layer disposed between the inner substrate and the adhesive layer and contacting the adhesive layer, the container component and the cover component being thermally adhered to one another along the first and second sealing faces, and a barrier layer disposed (i) between the inner substrate and the outer substrate, or (ii) on the second sealing layer of the inner substrate; wherein the barrier layer exhibits an oxygen permeability of less than 50 $cc/m^2/24$ hours; and wherein the opening force of the cover is less than 15 N/in, the method comprising:

disengaging a first portion of the cover component from a remaining second portion of the cover component and container component thermally adhered thereto, by separating the adhesive layer from the release layer to thereby open the package; and matingly contacting the adhesive to the release layer, to thereby reseal the package.

17. The method of claim 16 wherein the adhesive is a pressure sensitive adhesive.

18. The method of claim 16 wherein the container component and the cover component are thermally adhered to one another by:

contacting the first sealing layer of the container component to the second sealing layer of the cover component; and heating the first and second sealing layers to a temperature of from about 80° C. to about 140° C. for a time period of at least 1 second.

19. The method of claim 16 wherein the opening force of the cover component is less than 15 N/in, preferably from about 0.1 N/in to about 15 N/in, more preferably from about 2 N/in to about 10 N/in.

20. The resealable package assembly of claim 1 wherein the opening force of the cover is from about 2 N/in to about 10 N/in.

* * * * *